US005722613A

United States Patent [19]

Michael

[11] Patent Number: 5,722,613

[45] Date of Patent: Mar. 3, 1998

[54] EASY REEL DEVICE

[76] Inventor: Stephen A. Michael, 498 Bridgeport Dr., Port St. Lucie, Fla. 34953

[21] Appl. No.: 831,902

[22] Filed: Apr. 3, 1997

[51] Int. Cl.[6] ..... B65H 75/14; B65H 75/18

[52] U.S. Cl. ..... 242/600; 242/157 R; 242/580; 242/614; 242/615.2

[58] Field of Search ..... 242/579, 580, 242/600, 614, 615, 615.2, 157 R

[56] References Cited

U.S. PATENT DOCUMENTS

| | | | |
|---|---|---|---|
| D. 347,950 | 6/1994 | Cisero et al. | D6/456 |
| 444,866 | 1/1891 | Werner | 242/157 R |
| 2,743,884 | 5/1956 | Briggs | 242/157 R |
| 4,083,510 | 4/1978 | Gomez | 242/107 |
| 4,132,372 | 1/1979 | Worrel | 242/129.62 |
| 4,541,586 | 9/1985 | Crowe | 242/129.5 |
| 4,591,110 | 5/1986 | Wirts et al. | 242/129.8 |
| 5,002,238 | 3/1991 | Inhofer et al. | 242/157.1 |
| 5,222,683 | 6/1993 | Blackshire | 242/137.1 |
| 5,273,234 | 12/1993 | Hitomi | 242/241 |

*Primary Examiner*—William Stryjewski

[57] ABSTRACT

A easy reel device including a spool. The spool has a pair of spool rims with a cylindrical member for allowing material to be wrapped therearound when positioned between the pair of spool rims. Each spool rim has an interior side with a channel. An axle is positioned through the cylindrical member. Lastly, an elongated feeder bar is positioned within the channel of each spool rim and has a slot. The slot is capable of receiving a free end of the material wrapped around the cylindrical member of the spool.

7 Claims, 3 Drawing Sheets

EASY REEL DEVICE

BACKGROUND OF THE INVENTION

1. Field of the Invention

The present invention relates to a Easy reel device and more particularly pertains to providing a spool for holding and controlling the dispensing of material wound around the cylindrical member of the spool.

2. Description of the Prior Art

The use of a spool is known in the prior art. More specifically, spools heretofore devised and utilized for the purpose of holding wire, cord, rope and the like in a wound manner are known to consist basically of familiar, expected and obvious structural configurations, notwithstanding the myriad of designs encompassed by the crowded prior art which have been developed for the fulfillment of countless objectives and requirements.

By way of example, the prior art includes Des. U.S. Pat. No. 347,950 to Cisero and Travis discloses a spooled wire dispenser. U.S. Pat. No. 5,273,234 to Hitomi discloses a spinning reel with spool shaft and slider. U.S. Pat. No. 5,222,683 to Blackshire discloses a wire dispensing apparatus. U.S. Pat. No. 4,591,110 to Wirts and Corner discloses a wire storing and dereeling apparatus. U.S. Pat. No. 4,541,586 to Crowe discloses a rope reel display and dispenser assembly for perforated panel boards. Lastly, U.S. Pat. No. 4,132,372 to Worrell discloses a cable holder and dispenser.

In this respect, the easy reel device according to the present invention substantially departs from the conventional concepts and designs of the prior art, and in so doing provides an apparatus primarily developed for the purpose of providing a spool for holding and controlling the dispensing of material wound around the cylindrical member of the spool.

Therefore, it can be appreciated that there exists a continuing need for a new and improved easy reel device which can be used for providing a spool for holding and controlling the dispensing of material wound around the cylindrical member of the spool. In this regard, the present invention substantially fulfills this need.

SUMMARY OF THE INVENTION

In view of the foregoing disadvantages inherent in the known types of spools now present in the prior art, the present invention provides an improved easy reel device. As such, the general purpose of the present invention, which will be described subsequently in greater detail, is to provide a new and improved easy reel device which has all the advantages of the prior art and none of the disadvantages.

To attain this, the present invention essentially comprises a spool that has a pair of spool rims with a cylindrical member therebetween. The cylindrical member is capable of having material wrapped around it for holding the material in place when positioned between the pair of spool rims. Each spool rim has a peripheral edge with an interior side and an exterior side. Each spool rim has a center opening. The interior side of each spool rim has a circumference and a channel therein and extending the circumference of the interior side. The channel of each spool rim is near the peripheral edge of each spool rim. Also, an axle is positioned through the cylindrical member and seated within the center opening of each spool rim. The axle supports the cylindrical member between the pair of spool rims. The cylindrical member is capable of rotating about the axle and between the pair of spool rims. Included is an elongated feeder bar.

The feeder bar is generally rectangular in shape and has an elongated slot therein. The feeder bar is sized for simultaneous positioning within the channel of each spool rim. The feeder bar is arched to allow parallel movement around the cylindrical member when positioned within the channel of each spool rim. Lastly, an elongated flexible liner is fixedly attached to the slot of the feeder bar. The liner has an opening for receiving a free end of the material wrapped around the cylindrical member of the spool. The liner, within the slot of the feeder bar, is capable of guiding the material being dispensed from the spool, with the feeder bar holding the material in the wrapped orientation during dispensing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved easy reel device which has all the advantages of the prior art spools and none of the disadvantages.

It is another object of the present invention to provide a new and improved easy reel device which may be easily and efficiently manufactured and marketed.

It is a further object of the present invention to provide a new and improved easy reel device which is of a durable and reliable construction.

An even further object of the present invention is to provide a new and improved easy reel device which is susceptible of a low cost of manufacture with regard to both materials and labor, and which accordingly is then susceptible of low prices of sale to the consuming public, thereby making such easy reel device economically available to the buying public.

Still yet another object of the present invention is to provide a new and improved easy reel device which provides in the apparatuses and methods of the prior art some of the advantages thereof, while simultaneously overcoming some of the disadvantages normally associated therewith.

Still another object of the present invention is to providing a spool for holding and controlling the dispensing of material wound around the cylindrical member of the spool.

Lastly, it is an object of the present invention to provide a new and improved a spool. The spool has a pair of spool rims with a cylindrical member for allowing material to be wrapped therearound when positioned between the pair of spool rims. Each spool rim has an interior side with a channel. An axle is positioned through the cylindrical member. Lastly, an elongated feeder bar is positioned within the channel of each spool rim and has a slot. The slot is capable of receiving a free end of the material wrapped around the cylindrical member of the spool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
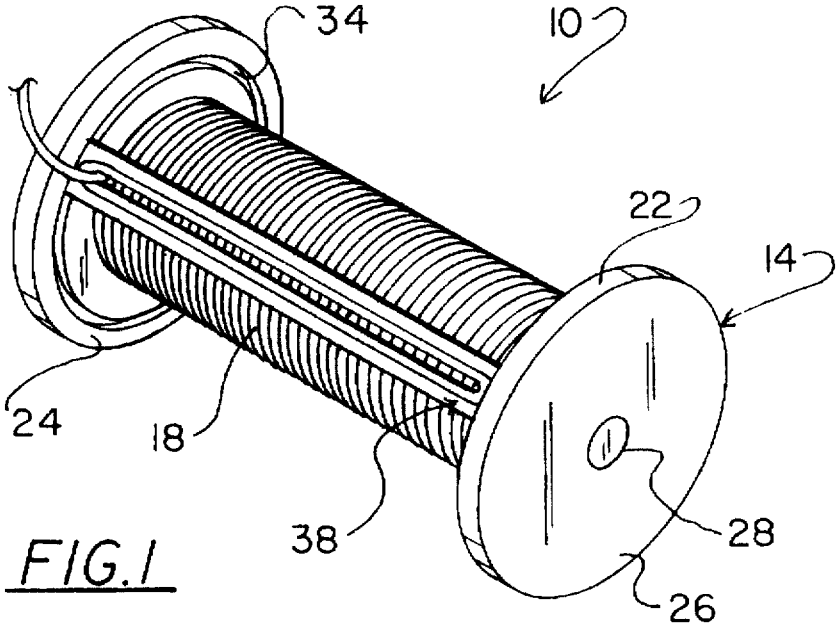
FIG. 1 is a perspective illustration of the preferred embodiment of the easy reel device constructed in accordance with the principles of the present invention.

With reference now to the drawings, and in particular to FIG. 1 thereof, a new and improved easy reel device embodying the principles and concepts of the present invention and generally designated by the reference numeral 10 will be described.

The present invention, the new and improved easy reel device, is comprised of a plurality of components. Such components in their broadest context include a spool, a feeder bar and a liner. Such components are individually configured and correlated with respect to each other so as to attain the desired objective.

Figure 2:
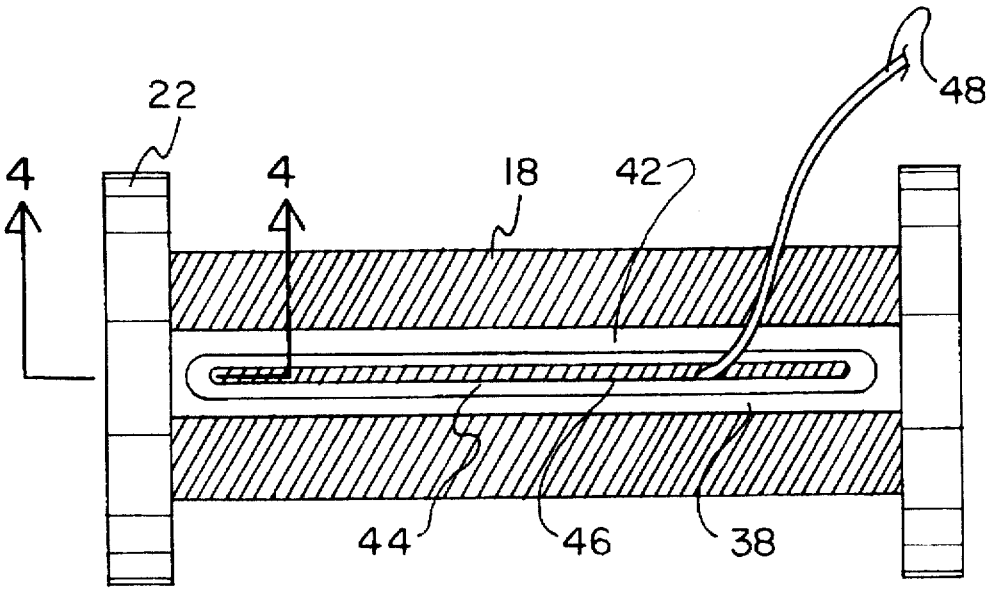
FIG. 2 is side view of the present invention easy reel device in an operable orientation.
Figure 3:
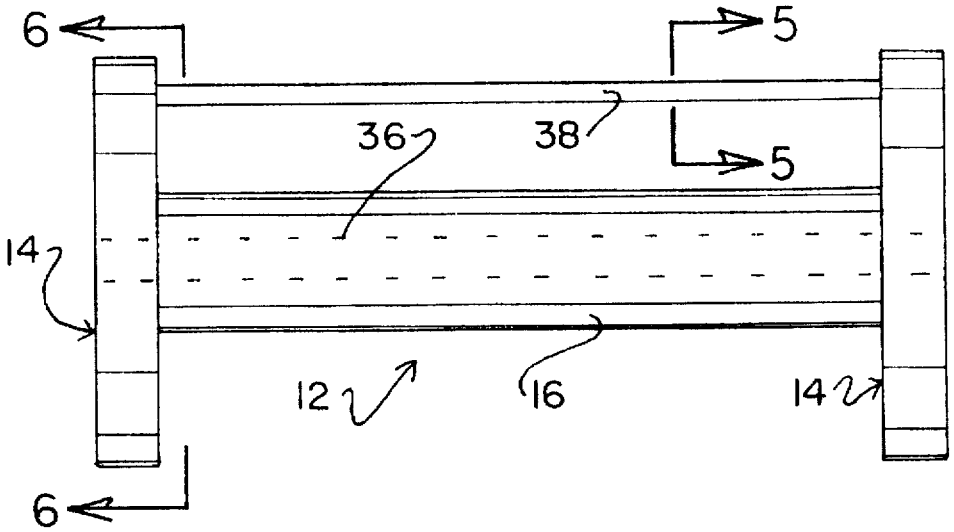
FIG. 3 is side view of the spool of the present invention of FIG. 1 with the wire removed.
Figure 4:
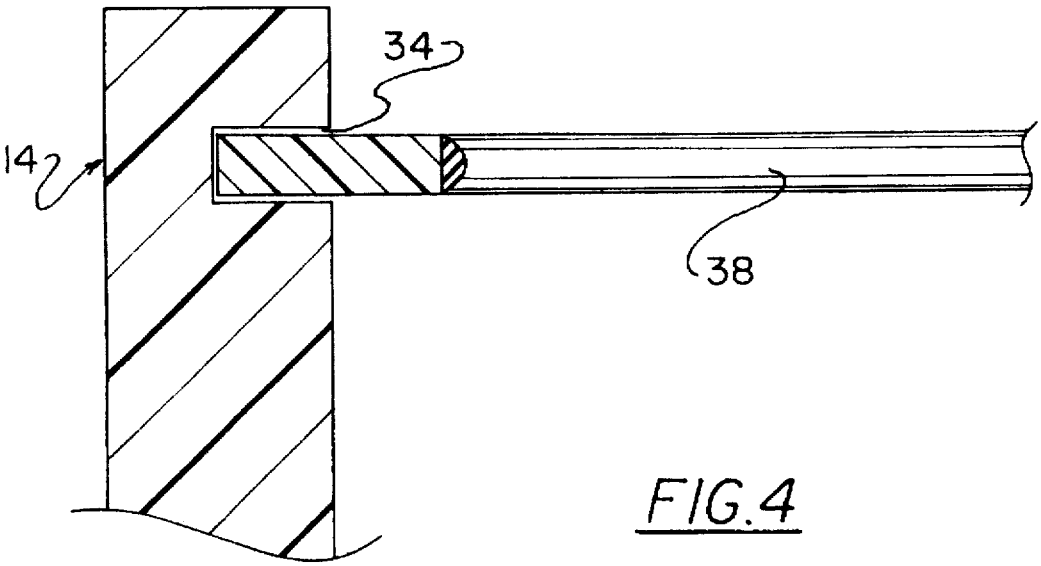
FIG. 4 is cross-sectional view of the present invention taken along line 4—4 of FIG. 2.
Figure 6:
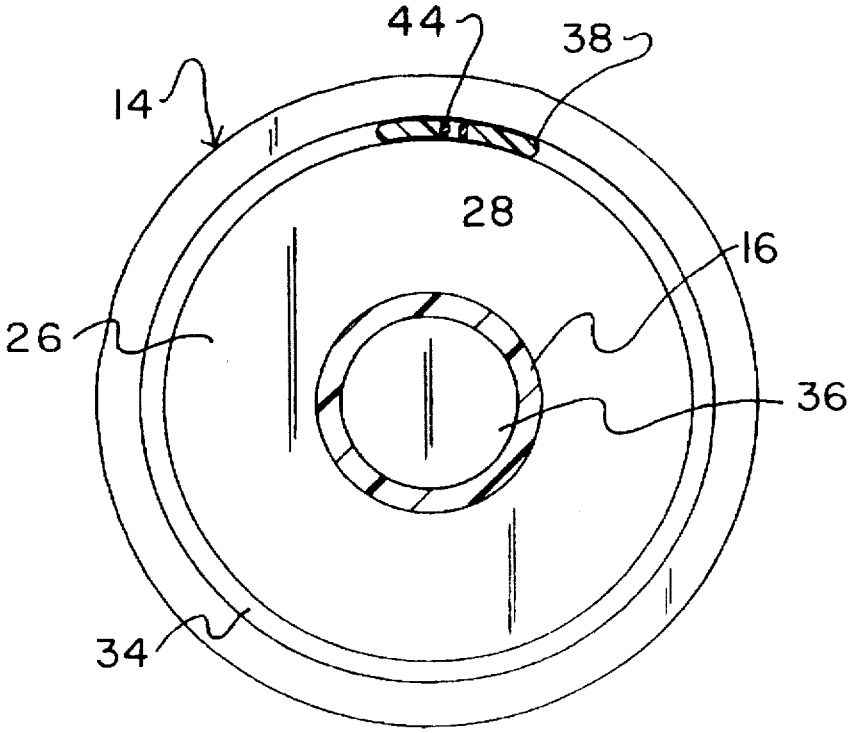
FIG. 6 is a cross-sectional view of the present invention taken along line 6—6 of FIG. 3.

More specifically, the present invention includes a spool 12, as shown in FIG. 3. The spool has a pair of spool rims 14 with a cylindrical member 16. The spool is produced of materials currently used commercially to manufacture spools. The cylindrical member is capable of having material 18 wrapped around. The material is held around the cylindrical member when it is positioned between the pair of spool rims. In FIG. 2, the material is a cord but, the material could be wire, rope, chain and the like. Each spool rim has a peripheral edge 22 with an interior side 24 and an exterior side 26 therebetween. Each spool rim has a center opening 28. The interior side of each spool rim has a circumference and, as shown in FIG. 6, a channel 34. The channel extends the entire circumference of the interior side. The channel of each spool rim is near the peripheral edge.

Also, an axle 36 is provided. The axle is positioned through the cylindrical member 16 and seated within the center opening 28 of each spool rim. As seen in FIG. 3, the axle supports the cylindrical member between the pair of spool rims. The cylindrical member is capable of rotating about the axle and between the pair of spool rims 14.

Figure 5:
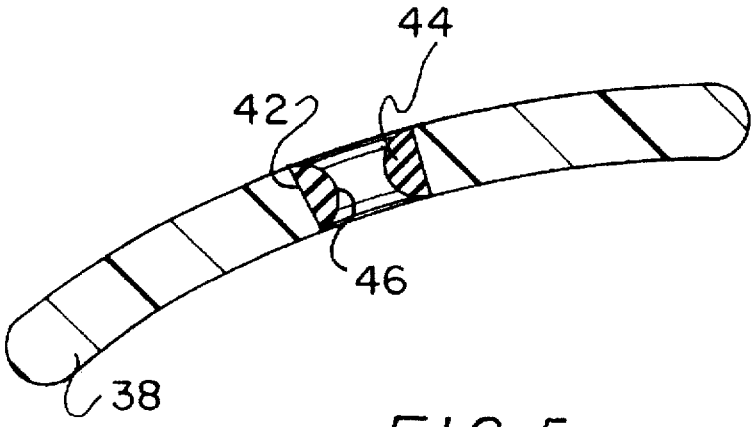
FIG. 5 is cross-sectional view of the feeder bar of the present invention taken along line 5—5 of FIG. 3.

Included is an elongated feeder bar 38. The feeder bar is generally rectangular in shape and formed of a rigid material. The feeder bar has an elongated slot 42, as best illustrated in FIG. 5. The feeder bar, as shown in FIG. 1, is sized for simultaneous positioning within the channel of each spool rim. FIG. 5 shows the feeder bar as arched. Arching of the feeder bar allows parallel movement of the feeder bar around the cylindrical member when is positioned within the channel of each spool rim. The arched shape of the feeder bar allows the feeder bar to move freely within each channel of each rim.

Lastly, an elongated flexible liner 44 is fixedly attached to the slot of the feeder bar 38. The liner may be a plastic or rubberized material. The liner has an opening 46 for receiving a free end 48 of the material 18 wrapped around the cylindrical member of the spool. The liner applies pressure to the material as it is passed through the liner's opening. The added pressure on the material prevents uncontrolled release of the material from around the cylindrical member. The liner, within the slot of the feeder bar, guides the material as it is dispensed from the spool with the feeder bar holding the material in the wrapped orientation during dispensing.

The present invention easy reel device is a spool for electrical and other types of wire and cable. The device is structured to prevent tangling of the wire during unwinding. The main feature of the present invention is a slotted feeder bar that fits into a channel on each of the spool rims. The feeder bar is able to travel around the circumference of the spool rims when positioned within the channel. For unwinding, the cable or wire, the free end of the wire is guided through the opening in the feeder bar. A flexible liner lines the opening of the feeder bar. The liner has a slot and applies moderate pressure upon the wire as it is unwound. The feeder bar guides the wire off the cylindrical member smoothly, and prevents coils of wire from loosening and falling off the spool.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved easy reel device for holding and dispensing spun material comprising in combination:

a spool having a pair of spool rims with a cylindrical member therebetween, the cylindrical member being capable of having material wrapped around for holding thereon when positioned between the pair of spool rims, each spool rim having a peripheral edge with an interior side and an exterior side therebetween, each spool rim having a center opening, the interior side of each spool rim having a circumference and a channel therein and extending the circumference of the interior side, the channel of each spool rim being near the peripheral edge thereof;

an axle being positioned through the cylindrical member and seated within the center opening of each spool rim for supporting the cylindrical member between the pair of spool rims, the cylindrical member capable of rotating about the axle and between the pair of spool rims;

an elongated feeder bar being generally rectangular in shape, the feeder bar having an elongated slot therein, the feeder bar being sized for simultaneous positioning within the channel of each spool rim, the feeder bar being arched to allow parallel movement around the cylindrical member when positioned within the channel of each spool rim; and an elongated flexible liner being fixedly attached to the slot of the feeder bar, the liner having an opening for receiving a free end of the material wrapped around the cylindrical member of the spool, the liner within the slot of the feeder bar capable of guiding the material being dispensed from the spool with the feeder bar holding the material in the wrapped orientation during dispensing.

2. An easy reel device comprising:

a spool having a pair of spool rims with a cylindrical member for having material wrapped therearound when positioned between the pair of spool rims, each spool rim having an interior side with a channel therein;

an axle being positioned through the cylindrical member; and an elongated feeder bar being positioned within the channel of each spool rim and having a slot therein, the slot capable of receiving a free end of the material wrapped around the cylindrical member of the spool.

3. The easy reel device as set forth in claim 2, wherein each spool rim having a peripheral edge with an exterior side and the interior side therebetween, and each spool rim having a center opening for receiving the axle to allow rotation of the cylindrical member when between the pair of spool rims.

4. The easy reel device as set forth in claim 3, wherein the interior side of each spool rim having a circumference with the channel extending the circumference of the interior side, and the channel of each spool rim being near the peripheral edge.

5. The easy reel device as set forth in claim 2, wherein the feeder bar being sized for simultaneous positioning within the channel of each spool rim, and the feeder bar being arched to allow parallel movement around the cylindrical member when positioned within the channel of each spool rim.

6. The easy reel device as set forth in claim 2, wherein the feeder bar including an elongated flexible liner with an opening, the liner being fixedly attached to the slot of the feeder bar, and the free end of the material passing through the liner attached to the slot of the feeder bar.

7. The easy reel device as set forth in claim 6, wherein the liner within the slot of the feeder bar capable of guiding the material being dispensed from the spool with the feeder bar holding the material in the wrapped orientation during dispensing.

* * * * *